US008925345B2

(12) United States Patent
Stephens et al.

(10) Patent No.: US 8,925,345 B2
(45) Date of Patent: Jan. 6, 2015

(54) SECONDARY COOLANT FINNED COIL

(75) Inventors: Arnold M. Stephens, Powhatan, VA (US); Chin Hoong Leong, Fairfield, IA (US); Adam C. Webb, Yale, VA (US); Zhiming Chen, Johns Creek, GA (US)

(73) Assignee: Hill Phoenix, Inc., Conyers, GA (US)

( * ) Notice: Subject to any disclaimer, the term of this patent is extended or adjusted under 35 U.S.C. 154(b) by 452 days.

(21) Appl. No.: 13/470,782

(22) Filed: May 14, 2012

(65) Prior Publication Data

US 2012/0305219 A1 Dec. 6, 2012

Related U.S. Application Data

(60) Provisional application No. 61/487,200, filed on May 17, 2011.

(51) Int. Cl.

| | |
|---|---|
| ***F25D 11/00*** | (2006.01) |
| ***F28D 1/047*** | (2006.01) |
| ***F25B 25/00*** | (2006.01) |
| *F28D 21/00* | (2006.01) |

(52) U.S. Cl.

CPC ..... *F28D 1/0475* (2013.01); *F25B 25/005* (2013.01); *F28D 2021/0071* (2013.01)

USPC ..... 62/440

(58) Field of Classification Search

USPC ..... 62/440, 515, 524, 525, 457.9; 165/104.11, 181

See application file for complete search history.

(56) References Cited

U.S. PATENT DOCUMENTS

| | | | | |
|---|---|---|---|---|
| RE29,438 | E | 10/1977 | MacCracken et al. | |
| 4,186,474 | A * | 2/1980 | Hine | 29/890.047 |
| 4,611,471 | A | 9/1986 | Ohashi | |
| 5,115,645 | A | 5/1992 | Abraham | |
| 5,127,155 | A * | 7/1992 | Kendic | 29/890.044 |
| 5,179,845 | A * | 1/1993 | Sasaki et al. | 62/515 |
| 5,341,870 | A * | 8/1994 | Hughes et al. | 165/110 |
| 5,924,479 | A * | 7/1999 | Egbert | 165/104.14 |
| 7,000,415 | B2 | 2/2006 | Daddis, Jr. et al. | |
| 7,841,208 | B2 * | 11/2010 | Lefor | 62/527 |
| 8,171,987 | B2 | 5/2012 | Jiang et al. | |
| 8,225,853 | B2 | 7/2012 | Macri et al. | |
| 8,235,101 | B2 | 8/2012 | Taras et al. | |
| 8,261,567 | B2 | 9/2012 | Zangari et al. | |
| 8,302,673 | B2 | 11/2012 | Taras et al. | |
| 8,307,669 | B2 | 11/2012 | Taras et al. | |
| 2008/0250805 | A1 | 10/2008 | Daddis et al. | |
| 2009/0019885 | A1 * | 1/2009 | Hoshino et al. | 62/515 |
| 2012/0000635 | A1 | 1/2012 | Porter et al. | |
| 2012/0011867 | A1 | 1/2012 | Koons et al. | |
| 2012/0118545 | A1 | 5/2012 | Ayub et al. | |
| 2012/0227945 | A1 | 9/2012 | Taras et al. | |

* cited by examiner

*Primary Examiner* — Melvin Jones
(74) *Attorney, Agent, or Firm* — Foley & Lardner LLP

(57) ABSTRACT

A heat exchanger has a fin pack, with a first supply header and a first return header at the first end of the fin pack. A first group of U-shaped tubes is provided with a first segment extending from the first supply header to the second end of the fin pack, and a second segment extending from the second end of the fin pack to the first return header. A second supply header and a second return header are also provided at the first end of the fin pack. A second group of U-shaped tubes is provided with a first segment extending from the second supply header to the second end of the fin pack, and a second segment extending from the second end of the fin pack to the second return header, where the second plurality of U-shaped tubes is disposed inwardly of the first plurality of U-shaped tubes.

15 Claims, 5 Drawing Sheets

SECONDARY COOLANT FINNED COIL

CROSS REFERENCE TO RELATED APPLICATIONS

The present Application claims the benefit of priority under 35 U.S.C. §119(e)(1) of U.S. Provisional Patent Application No. 61/487,200, titled "Secondary Coolant Finned Coil" and filed on May 17, 2011, the complete disclosure of which is incorporated herein by reference.

BACKGROUND

The present disclosure relates to a refrigeration system. The present disclosure relates more particularly to a refrigeration system having improved secondary coolant finned coils.

It is well known to provide a refrigeration system for use with one or more temperature controlled storage devices such as a refrigerator, freezer, refrigerated merchandiser, display case, etc., that may be used in commercial, institutional, and residential applications for storing or displaying refrigerated or frozen objects. For example, it is known to provide a refrigeration system having a refrigerant for direct expansion in a single loop operation to provide cooling to a heat exchanger such as an evaporator or chiller. It is also known to provide a secondary liquid coolant loop that is cooled by the chiller and then routed to various storage devices to provide cooling to temperature controlled objects. It is also known to pass the secondary coolant through a finned coil to remove a heat load from the storage device. One continuing challenge in secondary cooling is the pressure drop associated with the fluid passing through the finned coil. A refrigeration system having improved efficiency and thermal characteristics for use with temperature controlled storage devices is provided.

SUMMARY

One embodiment of the disclosure relates to a heat exchanger having a first end, a second end located opposite the first end, and a plurality of fins located between the first end and the second end. The heat exchanger further includes a first supply header located proximate the first end and a first return header located proximate the first end. A first tube segment couples to the first supply header and extends through the plurality of fins from the first end to the second end. A second tube segment couples to the first return header and extends through the plurality of fins from the first end to the second end. A third tube segment couples the first tube segment to the second tube segment proximate second end. In one embodiment, fluid flowing from the first supply header to the first return header passes through the plurality of fins only twice. In one embodiment, the heat exchanger further includes a second supply header located proximate the first end and a second return header located proximate the first end. A fourth tube segment couples to the second supply header and extends through the plurality of fins from the first end to the second end. A fifth tube segment couples to the second return header and extends through the plurality of fins from the first end to the second end. A sixth tube segment couples the fourth tube segment to the fifth tube segment proximate the second end. In one embodiment, a fluid flowing from the second supply header to the second return header passes through the plurality of fins only twice.

Another embodiment of the disclosure relates to a refrigeration system having a chiller configured to receive a refrigerant for chilling a coolant, and a pump for distributing the chilled coolant to at least one heat exchanger in at least one temperature controlled storage device. The heat exchanger includes fins spaced apart from one another in a substantially parallel arrangement to form a fin pack, with a first fin at a first end of the fin pack and a last fin at the second end of the fin pack. A first supply header is provided at the first end of the fin pack and a first return header is also provided at the first end of the fin pack. A first group of U-shaped tubes is provided with a first segment extending from the first supply header at the first end of the fin pack to the second end of the fin pack, and a second segment extending from the second end of the fin pack to the first return header at the first end of the fin pack. A second supply header is provided at the first end of the fin pack and a second return header is also provided at the first end of the fin pack. A second group of U-shaped tubes is provided with a first segment extending from the second supply header at the first end of the fin pack to the second end of the fin pack, and a second segment extending from the second end of the fin pack to the second return header at the first end of the fin pack, where the second plurality of U-shaped tubes is disposed inwardly of the first plurality of U-shaped tubes.

Another embodiment of the disclosure relates to heat exchanger having fins spaced apart from one another in a substantially parallel arrangement to form a fin pack, with a first fin at a first end of the fin pack and a last fin at the second end of the fin pack. A first supply header is provided at the first end of the fin pack and a first return header is also provided at the first end of the fin pack. A first group of U-shaped tubes is provided with a first segment extending from the first supply header at the first end of the fin pack to the second end of the fin pack, and a second segment extending from the second end of the fin pack to the first return header at the first end of the fin pack. A second supply header is provided at the first end of the fin pack and a second return header is also provided at the first end of the fin pack. A second group of U-shaped tubes is provided with a first segment extending from the second supply header at the first end of the fin pack to the second end of the fin pack, and a second segment extending from the second end of the fin pack to the second return header at the first end of the fin pack, where the second plurality of U-shaped tubes is disposed inwardly of the first plurality of U-shaped tubes.

DETAILED DESCRIPTION

Referring to the FIGURES, a refrigeration system is shown for use with one or more temperature controlled storage devices. The refrigeration system includes a primary cooling loop thermally coupled to a secondary cooling loop. The secondary cooling loop includes a finned coil located within a temperature controlled storage device. In use, the relatively warm air in the storage device passes across the fins of the coil. The coil may be located in the storage device such that natural convection moves air across the fins of the coil. Alternatively, a fan may be provided to circulate air within the storage device, thereby moving air across the fins of the coil. As air moves across the fins, heat from the air transfers to the relatively cooler fins. Heat from the fins transfers to the fluid of the secondary cooling loop and is thereby removed from the storage device.

Various storage devices may have different storage temperature requirements (e.g. "low temperature," such as approximately −20° F., or "medium temperature," such as approximately 25° F.). Storage devices may have a variety of applications. One example of a storage device is a refrigerated display case in a supermarket. A medium temperature refrigerated display case may have one or more glass doors and contain soft drinks, beer, water, juice, etc. A low temperature display case may contained ice cream, frozen vegetables, frozen dinners, etc.

The various temperatures of the storage device, refrigerants and liquid coolants illustrated or described in the various embodiments, are shown by way of example only. A wide variety of other temperatures and temperature ranges may be used to suit any particular application and are intended to be within the scope of this disclosure. Also, the various flow rates, capacity and balancing of coolants and refrigerants are described by way of example and may be modified to suit a wide variety of applications depending on the number of storage devices, the temperature requirements of the storage devices, etc.

Figure 1:
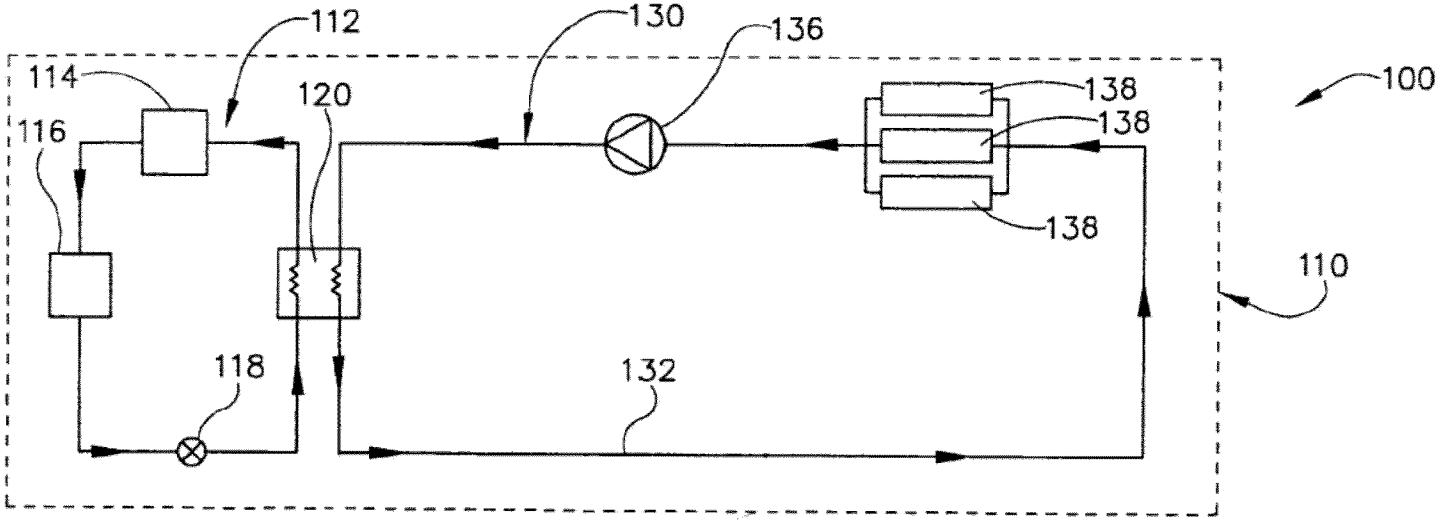
FIG. 1 is a schematic diagram of a refrigeration system having a liquid coolant supplied to storage devices, according to an exemplary embodiment.

Referring to FIG. 1, a refrigeration system 100 includes a first portion shown as portion 110 for use with temperature controlled storage devices having a "medium" storage temperature requirement (such as, for example, 25° F. and referred to herein as storage devices). According to alternative embodiments, portion 110 be used with temperature controlled storage devices having a "low" storage temperature requirement (such as, for example, −20° F.), or refrigeration system 100 may include a second portion for use with low temperature storage devices.

Portion 110 is shown to include a first (or primary) cooling loop 112 (e.g., formed from suitable conduits or passageways such as pipes, fittings, tubing, etc.) having a refrigerant (e.g., a direct expansion type refrigerant such as R404A, carbon dioxide, or other suitable refrigerant) as a cooling medium. The refrigerant is compressed by a compressor 114 to a high temperature and high pressure state, and is then cooled in a condenser 116, then expanded in an expansion device (such as an expansion valve 118) to provide a source of cooling to a heat exchanger operating as a cooling element (such as a cooling coil, evaporator, etc), shown as a chiller 120. According to one embodiment, the components of first cooling loop 112 operate to provide refrigerant at a temperature of approximately 13° F. to the chiller 120. In practice, primary cooling loop 112 extends remotely from chiller 120. For example, compressor 114 and condenser 116 may be located on the roof of a building. According to alternative embodiments, primary cooling loop 112 remains proximate chiller 120. According to various embodiments, the primary cooling 112 may be a single-phase or two phase system. In a two phase system the refrigerant entering chiller 120 is heated from a liquid phase to a vapor (or gas) phase. In a single phase system, refrigerant entering chiller 120 is heated but remains a liquid.

Portion 110 also includes a second (or secondary) cooling loop 130 having a first portion 132. According to one embodiment, the second cooling loop 130 is cooled by the refrigerant in chiller 120 to a temperature of approximately 20° F. A liquid coolant (such as glycol, water, other liquids, or other suitable refrigerant) is circulated through the first portion 132 by a pump 136 to provide cooling to a heat exchanger (such as a finned coil) within one or more storage devices (shown for example as three storage devices 138). According to the exemplary embodiment, secondary cooling loop 130 is a single phase loop. According to one alternative embodiment, secondary cooling loop 130 includes a second portion (e.g. circuits, branches, flow paths, etc.—formed from suitable conduits or passageways such as pipes, fittings, tubing, etc.) for circulation of a liquid coolant (such as water, glycol, etc.) as a cooling medium by pump 136. The second portion of secondary cooling loop 130 may be thermally coupled to a condenser of a second portion (e.g., low temperature portion) of refrigeration system 100. According to other alternative embodiments, other components or equipment such as a receiver, a sub-cooler, liquid line or suction line filter, oil management system, etc., may be included in the system.

Figure 2:
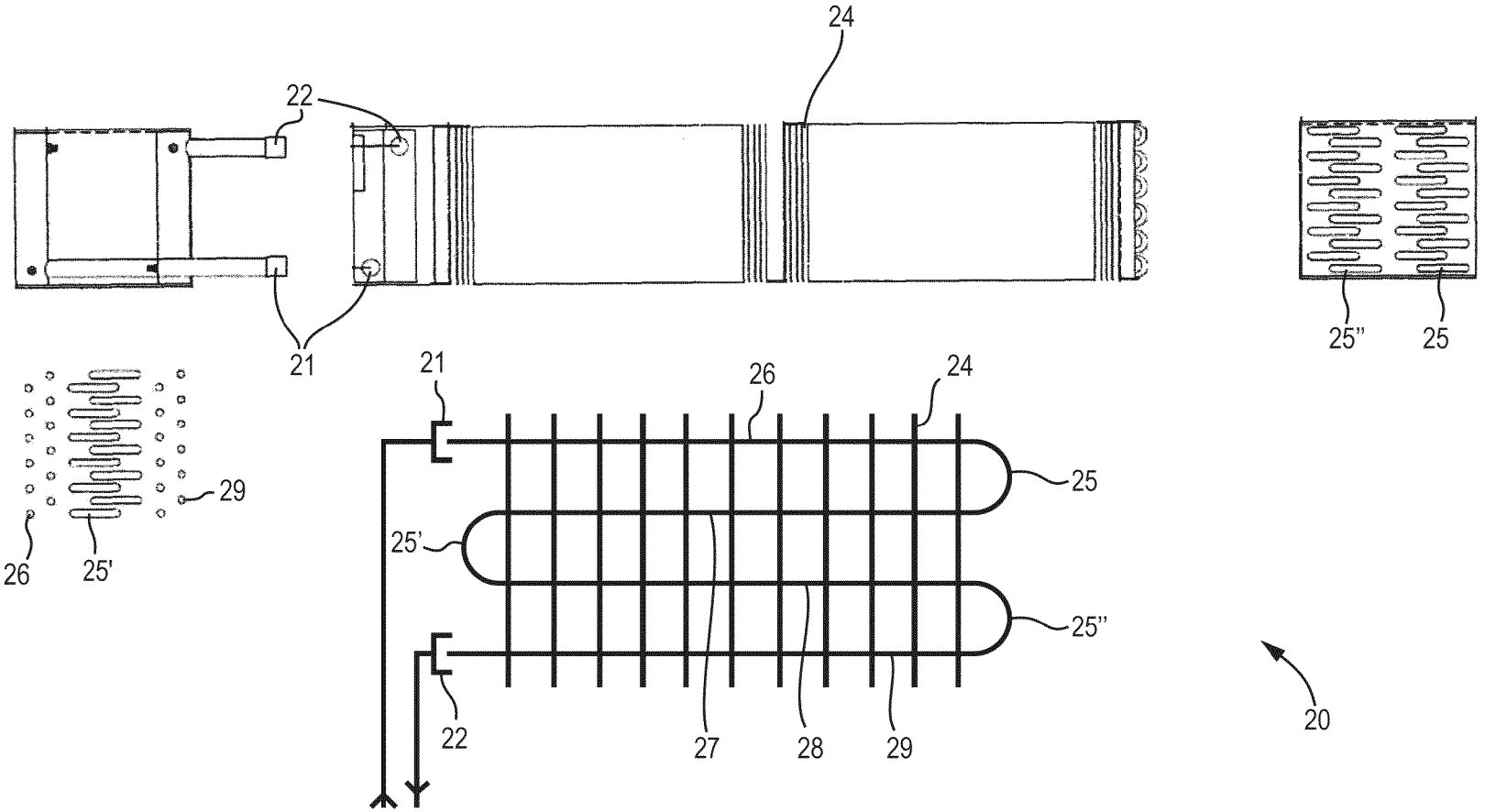
FIGURE 2 (PRIOR ART)
FIG. 2 is a schematic diagram of a secondary coolant finned coil as known in the prior art.

Referring to FIG. 2, a secondary coolant finned evaporator coil, shown as coil 20, is shown according to a prior art embodiment. Coil 20 includes a plurality of fins 24 longitudinally spaced apart and extending laterally across coil 20. Coil 20 includes an inlet header 21 and a return header 22, which are shown located on an inlet side of the coil. Inlet header 21 delivers coolant to a plurality of first tubes 26, which extend longitudinally through fins 24. At the far end of the coil, first tubes 26 couple to first bends 25 (e.g., elbows, U-tubes, return bends, etc.). First bends 25 are coupled to second tubes 27 which extend longitudinally towards the inlet end of the coil. Second tubes 27 couple to second bends 25', which couple to third tubes 28. Third tubes 28 extend longitudinally to the far end of the coil with a couple to third bends 25". Third bends 25" couple to fourth tubes 29 which extend longitudinally towards the inlet end where they are shown to couple outlet header 22. As described and shown in FIG. 2, coil 20 is typically referred to as a four pass coil. That is, coolant passes through fins 24 four times through first tubes 26, second tubes 27, third tubes 28, and fourth tubes 29. Other conventional coils, may have additional bends and tubes to form additional passes, for example, six pass or eight pass coils, etc.

One factor in optimizing performance in a single phase fluid coil is minimizing the pressure drop associated with a fluid passing through the coil. Coil 20, exemplary of other conventional coils, has a single inlet header 21 and a single outlet header 22 that feeds the tubes within the coil 20. To minimize the pressure drop through coil 20, inlet header 21 is designed to feed many tubes (see e.g., first tubes 26 and fourth tubes 29) and sometimes can feed over 12 to 16 tubes. Generally, the more tubes that inlet header 21 can feed results in less fluid pressure drop through coil 20. The drawback is the additional cost, manufacturing time, and complexity of these headers 21. This complexity also limits the number of tubes 26 that the header can feed and results in the coil having return bends 25' on the inlet side of coil 20. Each circuit of coil 20 includes four or more tubes and three or more bends, which may increase the residence time of the coolant within the fins, thereby increasing heat transfer to the coolant, but which also increase the pressure drop through coil 20.

Figure 3:
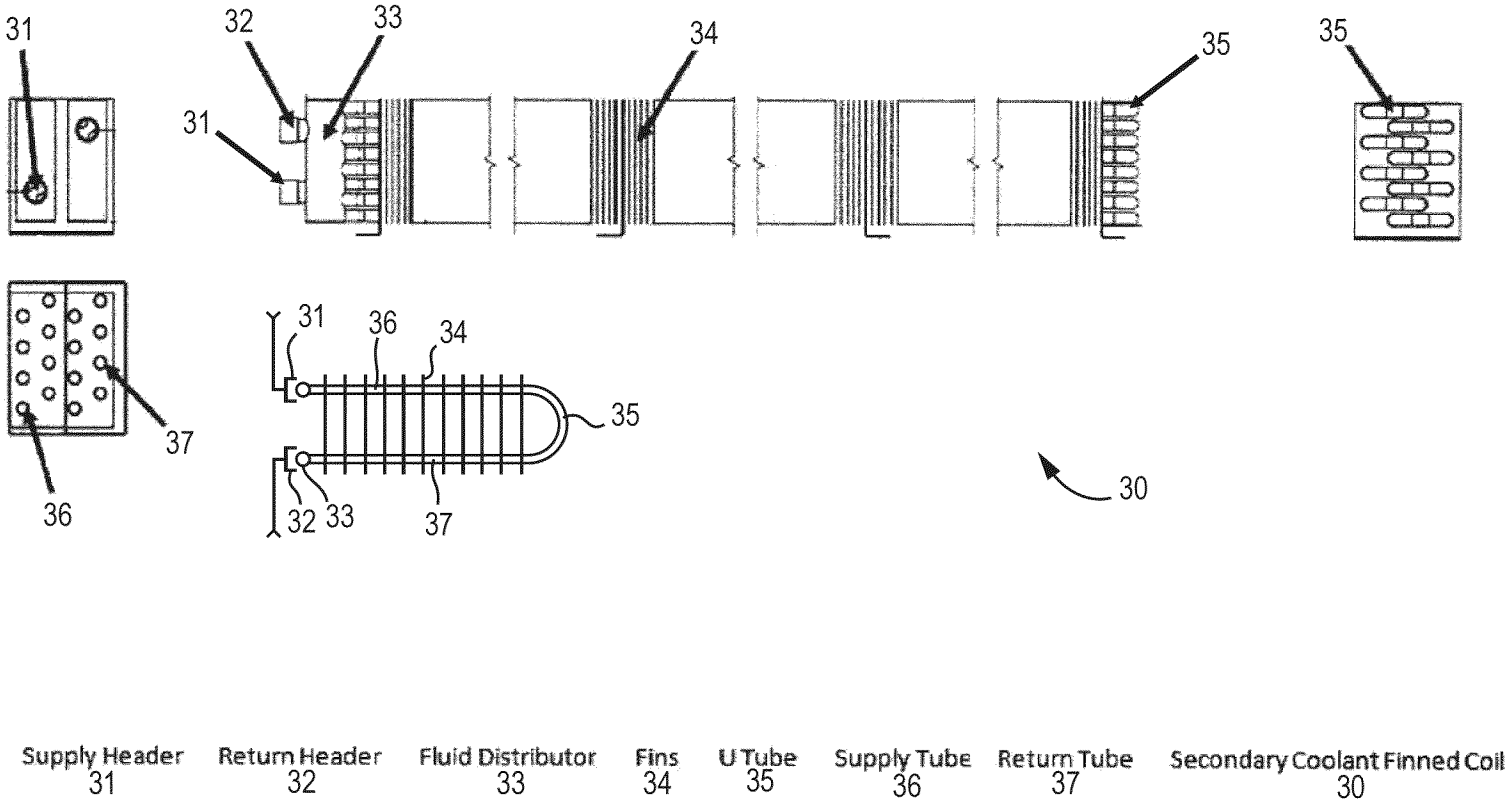
FIG. 3 is a schematic diagram of a secondary coolant finned coil having one inlet header and one outlet header, according to an exemplary embodiment.

Referring to FIG. 3, an improved secondary coolant finned coil, shown as coil 30, is shown according to an exemplary embodiment. Coil 30 includes a plurality of fins 34 longitudinally spaced apart and extending laterally across coil 30.

Coil 30 includes a supply header 31 located on an inlet side of coil 30. Supply header 31 distributes coolant through a fluid distributor (shown as manifold 33 on the return side) to supply tubes 36 (pipes, fittings, tubing, conduits, etc.). According to the exemplary embodiment, supply tubes 36 (shown by way of example as eight supply tubes) extend in parallel and longitudinally to the far end of coil 30 where they couple to bends 35 (e.g., elbows, U-tubes, return bends, etc.). Bends 35 couple to return tubes 37 (pipes, fittings, tubing, conduits, etc.) which extend longitudinally to manifold 33, which in turn returns coolant to return header 32. According to alternate embodiments, supply tubes 36 and return tubes 37 may include any number of tubes which may or may not be parallel. According to one embodiment, a supply tube 36, a bend 35, and a return tube 37 may be segments of one tube.

Figure 4:
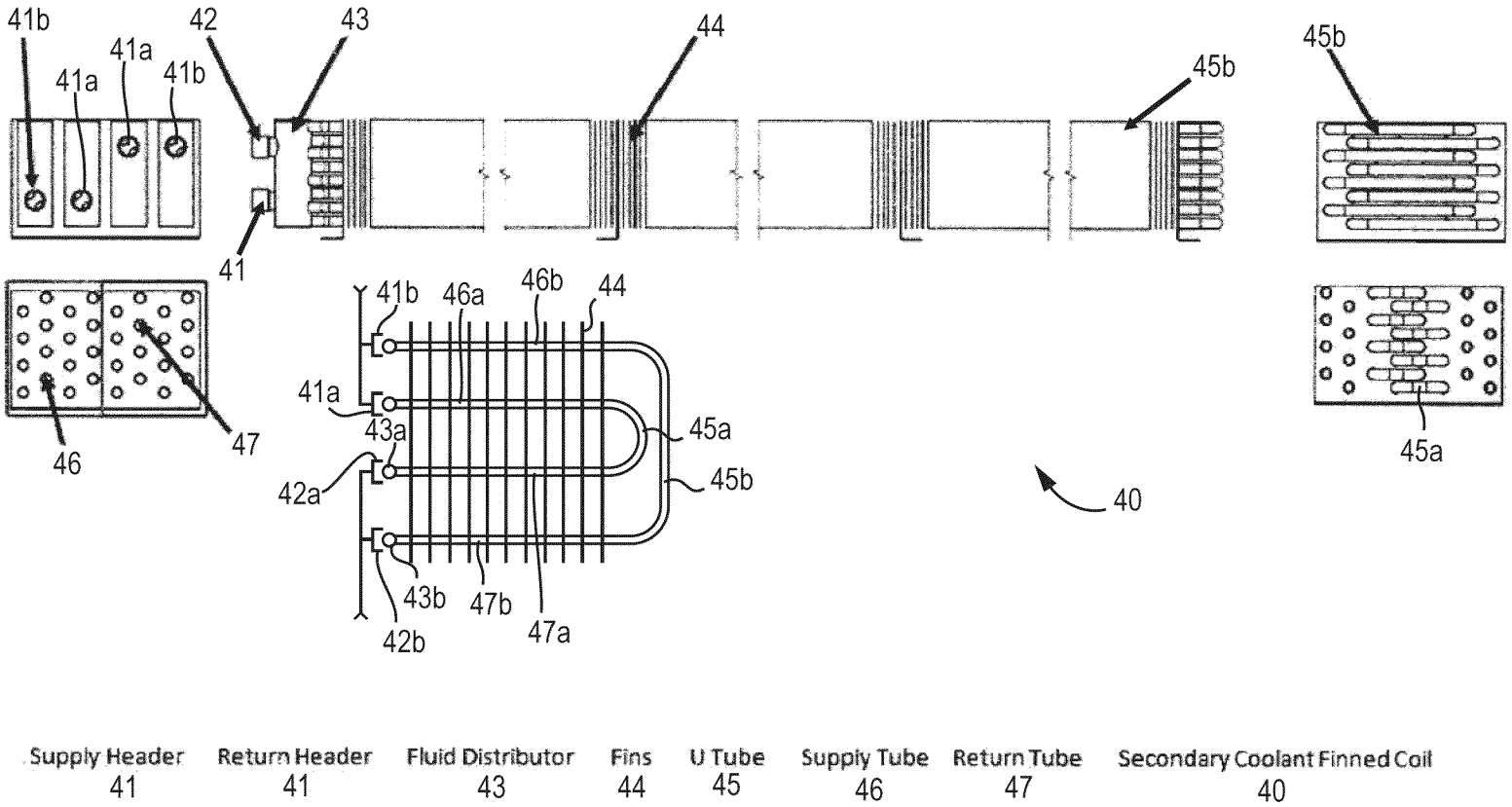
FIG. 4 is a schematic diagram of a secondary coolant finned coil having two inlet headers and two outlet headers, according to an exemplary embodiment.

Referring to FIG. 4, a secondary coolant finned coil, shown as coil 40, is shown according to an exemplary embodiment. Coil 40 includes a plurality of fins 44 longitudinally spaced apart and extending laterally across coil 40. Coil 40 includes a first supply header 41*a*, a second supply header 41*b*, a first return header 42*a*, and a second return header 42*b*. As shown, supply headers 41 and return headers 42 are located at an inlet end of coil 40. Supply headers 41 distribute coolant to supply tubes 46 through fluid distributors, shown as manifolds 43. According to the exemplary embodiment, first supply header 41*a* is coupled to parallel supply tubes 46*a* (shown by way of example as eight supply tubes), which extend longitudinally to the far end of coil 40 where they couple to bends 45*a*. Bends 45*a* couple to return tubes 47*a*, which extend longitudinally to a manifold 43*a* coupled to return header 42*a*. Similarly, second supply header 41*b* is coupled to eight parallel supply tubes 46*b*, which extend longitudinally to the far end of coil 40 where they couple to bends 45*b*. Bends 45*b* couple to return tubes 47*b*, which extend longitudinally to a manifold 43*b* coupled to return header 42*b*. According to alternate embodiments, supply tubes 46 and return tubes 47 may include any number of tubes which may or may not be parallel. According to one embodiment, a supply tube 46, a bend 45, and a return tube 47 may be segments of one tube.

As shown, first supply header 41 a and first return header 42*a* form an inner circuit, and second supply header 42*b* and second return header 42*b* form an outer circuit. The inner circuit and outer circuit carry coolant in parallel. According to the exemplary embodiment, the inner circuit and the outer circuit pass through a common set of fins 44. According to an alternate embodiment, the inner circuit in the outer circuit may pass through independent sets of fins. For example, the inner circuit may be the embodiment shown in FIG. 3, and the outer circuit may be added around the inner circuit. In this manner, the cooling capacity to storage device 138 may be increased with minimal plumbing changes and without removing the existing inner circuit. According to one embodiment, the tubes and bends of both the inner and outer circuit have substantially similar diameters. According to an alternate embodiment, the tubes and bends of the outer circuit have a greater diameter than the tubes and bends of the inner circuit. The larger diameter of the outer circuit tubes and bends may compensate for the greater distance traveled, thereby maintaining a similar pressure drop through the coil as that of the inner circuit. Furthermore, the larger diameter enables more coolant to pass through the outer circuit, which may create a similar cooling per unit length as the inner circuit, thereby reducing potential hotspots near the end of the outer circuit.

According to one embodiment, an overall length of coil 40 is between approximately 77 inches and approximately 94 inches. According to another embodiment, the overall length of coil 40 is between approximately 80 inches and approximately 90 inches. According to the embodiment shown, the distance from the inlet end side of manifold 43 to the far end side of bend 45*b* is approximately 85 1/16 inches. According to one embodiment, the longitudinal fin length of coil 40 is between approximately 70 inches and approximately 90 inches. According to the embodiment shown, the distance from the first fin 44 on the inlet end of coil 40 to the last fin 44 on the far end of coil 40 is approximately 80 inches. According to one embodiment, the fin height of coil 40 is between approximately 4 inches and approximately 6 inches. According to the embodiment shown, the vertical height of fins 44 of coil 40 is approximately 5 inches. Coil 40 may include members configured to support the coil. According to one embodiment, the support members are longitudinally spaced along coil 40 at intervals of between approximately 24 inches and approximately 30 inches. According to the embodiment shown, the support members are longitudinally spaced along coil 40 at intervals of approximately 26 21/32 inches. According to one embodiment, supply headers 41 and return headers 42 have outside diameters between approximately 1 inch and approximately 2 inches. According to the embodiment shown, supply headers 41 and return headers 42 have outside diameters of approximately 1 5/8 inches. According to the embodiment shown, supply headers 41 and return headers 42 have inside diameters of approximately 7/8 inches. According to one embodiment, supply tubes 46 and return tubes 47 have diameters of greater than 3/8 inch. According to another embodiment, supply tubes 46 and return tubes 47 have diameters between approximately 3/8 inch and approximately 5/8 inch. According to the embodiment shown supply tubes 46 and return tubes 47 have diameters of approximately 1/2 inch. According to other embodiments, the coil and associated components may have different dimensions, sizes, lengths, diameters, etc.

Figure 5:
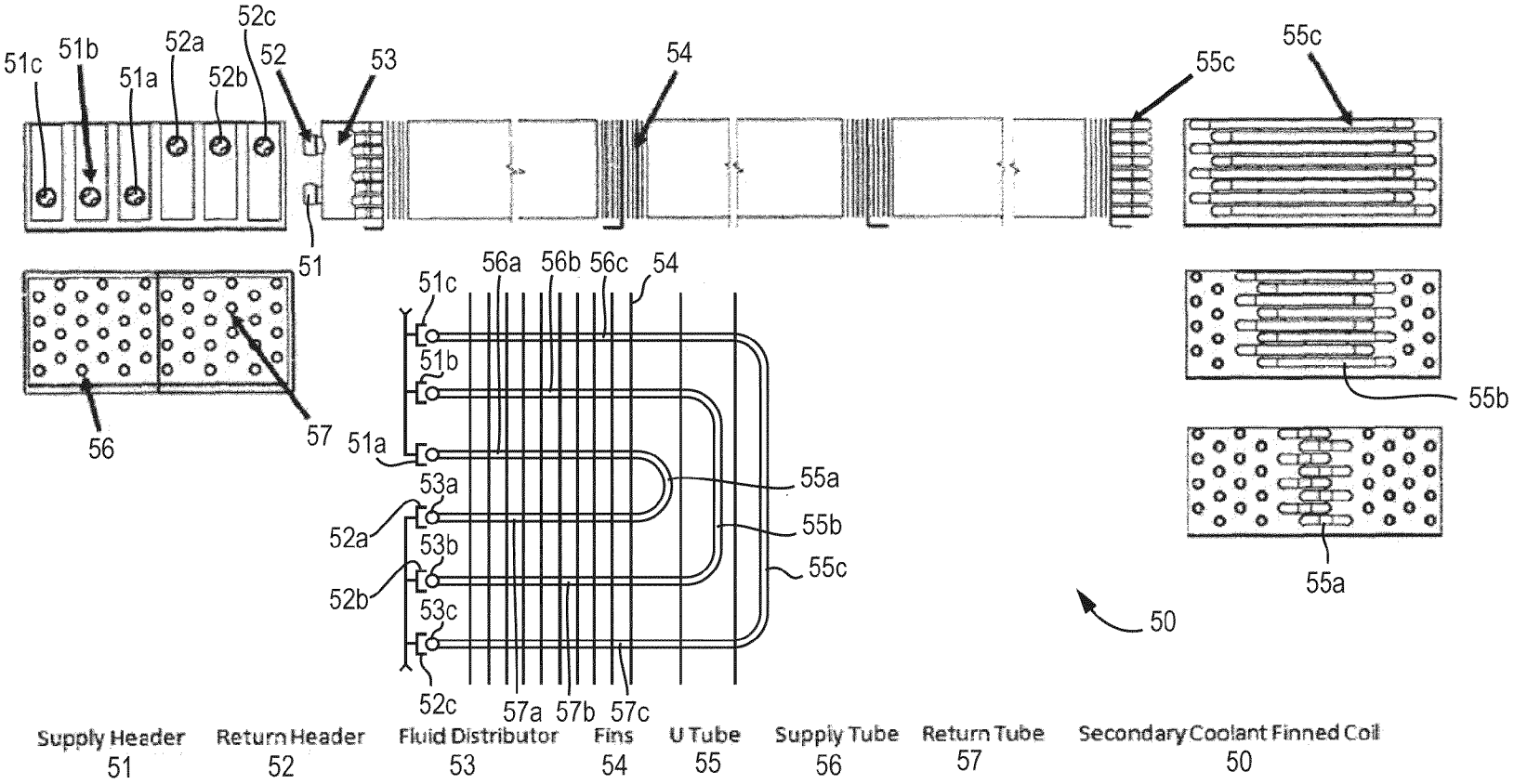
FIG. 5 is a schematic diagram of a secondary coolant finned coil having three inlet headers and three outlet headers, according to an exemplary embodiment.

Referring to FIG. 5, a secondary coolant finned coil, shown as coil 50, is shown according to an exemplary embodiment. Coil 50 includes a plurality of fins 54 spaced longitudinally apart and extending laterally across coil 50. Coil 50 includes a first supply header 51*a*, a second supply header 51*b*, a third supply header 51*c*, a first return header 52*a*, a second return header 52*b*, and a third return header 52*c*, which are located at an inlet end of coil 50. Supply headers 51 distribute coolant to supply tubes 56 through fluid distributors, shown as manifolds 53. According to the exemplary embodiment, first supply header 51*a* is coupled to parallel supply tubes 56*a* (shown by way of example as eight supply tubes), which extend longitudinally to the far end of coil 50 where they couple to bends 55*a*. Bends 55*a* couple to return tubes 57*a*, which extend longitudinally to a manifold 53*a* couple to return header 52*a*. As shown, this forms an inner circuit. An exemplary middle circuit is formed by second supply header 51*b*, a fluid distributor, eight supply tubes 56*b*, bends 55*b*, eight return tubes 57*b*, a return manifold 53*b*, and a return header 52*b*. An exemplary outer circuit is formed by third supply header 51*c*, a fluid distributor, eight supply tubes 56*c*, bends 55*c*, eight return tubes 57*c*, a return manifold 53*c*, and return header 52*c*. According to various embodiments, one or more additional circuits may be similarly formed around the outer circuit. According to alternate embodiments, supply tubes 56 and return tubes 57 may include any number of tubes which may or may not be parallel. According to one embodiment, a supply tube 56, a bend 55, and a return tube 57 may be segments of one tube.

According to the exemplary embodiment shown, the inner circuit, the middle circuit, and the outer circuit, pass through a common set of fins 54. The inner circuit, the middle circuit, and the outer circuit, are coupled to the secondary cooling loop 130 in parallel. According to various alternate embodiments the inner circuit, the middle circuit, and the outer circuit may pass through any combination of common or independent sets of fins. For example, the inner circuit in the middle circuit may pass through common set of fins 54, and an outer circuit having its own set of fins may be added around the middle circuit. In this manner, the cooling capacity to storage device 138 may be increased with minimal plumbing and without removing the existing inner and middle circuits.

According to one embodiment, the tubes and bends of the inner, middle, and outer circuits have substantially similar diameters. According to various alternate embodiments, the circuits may have different diameter tubes and bends. As such, the diameter of a circuit's tubes and bends may be selected to compensate for the pressure drop resulting from the increased distance traveled, thereby creating substantially similar pressure drops through each circuit. According to one embodiment, the diameter of the tubes and bends of the outer circuit is greater than the diameter of the tubes and bends of the middle circuit, which in turn is greater than the diameter of the tubes and bends of the inner circuit.

According to the embodiment shown in FIG. 4, bends 45*a* and 45*b* all extend beyond the last fin at the far end of the coil. According to the embodiment shown in FIG. 5, bend 55*c* extends beyond the last fin, bend 55*b* extends between the last fin and the next to last fin, and bend 55*a* extends between the second to last fin and the next to last fin. According to various embodiments, the bends maybe located between any fins. Adding fins between the bends takes advantage of the space available to increase the total fin surface area and thereby increase cooling capacity.

As described and shown in FIGS. 3, 4, and 5, coil 30, coil 40, and coil 50 are two pass coils. That is, coolant passes through the fins (34, 44, 54) two times: once through the supply tubes (36, 46, 56), and once through the return tubes (37, 47, 57). Limiting the number of passes each circuit takes through the coil reduces the number of bends and the number of tubes and the length of the circuit from inlet to outlet, thereby decreasing the pressure drop through the coil and increasing the heat transfer capability of the coil. Limiting the number of passes each circuit takes through the coil reduces the change in temperature laterally and longitudinally across the coil as coolant acquires heat traveling from the supply header (31, 41, 51) to the return header (32, 42, 52). Reducing the pressure drop through the coil enables a slower flow rate of coolant through the coil. Lower pressure drop through the coil and slower flow rate of coolant through the coil require less pumping power; therefore, less energy is used by rack equipment such as pump 136.

According to the embodiments shown, all of the circuits flow laterally from left to right. According to alternative embodiments, any number of circuits may be configured to flow laterally from right to left. For example, in coil 50, the inner circuit and the outer circuit may flow laterally from left to right, and the middle circuit may flow laterally from right to left. This may reduce the change in temperature laterally across the coil, thereby creating a more even temperature distribution in storage device 138.

According to the exemplary embodiment, coil 30, coil 40, and coil 50 are modular and/or stackable. According to one embodiment, a first finned coil (e.g., coil 30, coil 40, or coil 50) forms a first module and a second finned coil (e.g., coil 30, coil 40, or coil 50) forms a second module. The first module and the second module may be oriented such that the relatively warm air of storage device 138, after passing through the fins of the first module, passes through the fins of the second module, thereby being cooled even further. This increases the cooling capacity available to storage device 138. This also increases the cooling capacity available for use in applications such as condensers, etc. Furthermore, the modularity of the stacked coils facilitates repair by enabling one module to be shut off (e.g., by valve) while maintaining coolant flow to the second module. According to various embodiments, any number of coils may be stacked to form a heat exchanger unit. According to another embodiment, the inner circuit forms a first module having a first set of fins 54*a*, the middle circuit forms a second module having a second set of fins 54*b*, and the outer circuit forms a third module having a third set of fins 54*c*. Modules may be installed subsequently, in any order, and in any number to achieve the desired cooling capacity for storage device 138.

According to the embodiments shown, the supply tubes and return tubes extend longitudinally through laterally extending fins. According to alternate embodiments, the supply tubes and return tubes extend laterally through longitudinally extending fins. In such a configuration, a module having longitudinal fins may be stacked on a module have lateral fins in order to create certain air flow and heat exchange properties.

Using multiple headers as shown in FIGS. 4 and 5 reduces the complexity of conventional headers. Reducing the complexity of the header reduces cost, manufacturing time, and pressure drop. Using multiple headers facilitates larger scale manufacture of interchangeable headers rather than making complex headers dependent on the number of tubes required. This enables headers to be made in advance, reduces manufacturing time, and facilitates repair by having stock headers available for replacement. To these ends, a supply header and fluid distributor assembly may be substantially the same as a return header and manifold assembly. According to one embodiment, a return header 52 and manifold 53 may be inverted and installed as a supply header 51 and fluid distributor. Furthermore, multiple headers enables the circuits to be isolated. For example, an outer circuit could be shut off for repair while the inner and middle circuits continued to provide cooling to storage device 138. As such, chilled product in storage device 138 may not need to be moved during repairs, thereby saving time and the costs of obtaining and cooling another refrigerated storage device.

It is also important to note that the construction and arrangement of the elements of the coil as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the enclosure may be constructed from any of a wide variety of materials that provide sufficient strength or durability, in any of a wide variety of colors, textures, and combinations. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner. Accordingly, all such modifications are intended to be included within the scope of the present inventions. Other substitutions, modifications, changes, and omissions may be made in the design, operating conditions, and arrangement of the preferred and other exemplary embodiments without departing from the spirit of the appended claims.

The various temperatures of the storage devices and the refrigerants illustrated or described in the various embodiments, are shown by way of example only. A wide variety of other temperatures and temperature ranges may be used to suit any particular application and are intended to be within the scope of this disclosure. Also, the various flow rates, capacity and balancing of refrigerants are described by way of example and may be modified to suit a wide variety of applications depending on the number of storage devices, the temperature requirements of the storage devices, the heating demands from the heat loads, the pressure drops through the one or more sections of the heat exchanger(s), etc.

It should also be noted that any references to "upstream," and "downstream" in this description are merely used to identify the various elements as they are oriented in the FIGURES, being relative to a specific direction. These terms are not meant to limit the element which they describe, as the various elements may be oriented differently in various applications.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

Before discussing further details of the coil, it should be noted that references to "lateral," "right," and "left" in this description are merely used to identify the various elements as they are oriented in the FIGURES, with "right," "left," and "lateral" being relative to a specific direction. These terms are not meant to limit the element which they describe, as the various elements may be oriented differently in various applications.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the spirit of the appended claims.

What is claimed is:

1. A heat exchanger for a refrigeration device, comprising:

a plurality of fins spaced apart from one another in a substantially parallel arrangement to form a fin pack, with a first fin at a first end of the fin pack and a last fin at the second end of the fin pack;

a first supply header disposed proximate the first end of the fin pack and a first return header disposed proximate the first end of the fin pack;

a first plurality of U-shaped tubes having a first segment extending from the first supply header at the first end of the fin pack to the second end of the fin pack, and a second segment extending from the second end of the fin pack to the first return header at the first end of the fin pack;

a second supply header disposed proximate the first end of the fin pack and a second return header disposed proximate the first end of the fin pack;

a second plurality of U-shaped tubes having a first segment extending from the second supply header at the first end of the fin pack to the second end of the fin pack, and a second segment extending from the second end of the fin pack to the second return header at the first end of the fin pack;

wherein the second plurality of U-shaped tubes is nested within the first plurality of U-shaped tubes.

2. The heat exchanger of claim 1 further comprising:

a third supply header disposed proximate the first end of the fin pack and a third return header disposed proximate the first end of the fin pack; and a third plurality of U-shaped tubes having a first segment extending from the third supply header at the first end of the fin pack to the second end of the fin pack, and a second segment extending from the second end of the fin pack to the third return header at the first end of the fin pack;

wherein the third plurality of U-shaped tubes is nested within the second plurality of U-shaped tubes.

3. The heat exchanger of claim 2 wherein the first and second segments of the first, second and third plurality of U-shaped tubes are all substantially parallel to one another, and substantially perpendicular to the plurality of fins.

4. The heat exchanger of claim 3 wherein each of the first, second and third plurality of U-shaped tubes includes a third segment connecting the first and second segments.

5. The heat exchanger of claim 4 wherein each of the first, second and third plurality of U-shaped tubes is configured to direct a coolant through the fin pack only twice to minimize pressure drop through the fin pack.

6. The heat exchanger of claim 1 further comprising a first supply manifold fluidly communicating between the first supply header and the first segment of the first plurality of U-shaped tubes, and a first return manifold fluidly communicating between the first return header and the second segment of the first plurality of U-shaped tubes.

7. The heat exchanger of claim 6 further comprising a second supply manifold fluidly communicating between the second supply header and the first segment of the second plurality of U-shaped tubes, and a second return manifold fluidly communicating between the second return header and the second segment of the second plurality of U-shaped tubes.

8. The heat exchanger of claim 7 further comprising a third supply manifold fluidly communicating between the third supply header and the first segment of the third plurality of U-shaped tubes, and a third return manifold fluidly communicating between the third return header and the second segment of the third plurality of U-shaped tubes.

9. The heat exchanger of claim 8 wherein the first, second and third supply manifolds are coextensive with one another.

10. The heat exchanger of claim 8 wherein the first, second and third return manifolds are coextensive with one another.

11. A refrigeration system, comprising:

a chiller configured to receive a refrigerant for chilling a coolant;

a pump for distributing the chilled coolant to at least one heat exchanger in at least one temperature controlled storage device;

wherein the heat exchanger comprises:

a plurality of fins spaced apart from one another in a substantially parallel arrangement to form a fin pack, with a first fin at a first end of the fin pack and a last fin at the second end of the fin pack;

a first supply header disposed proximate the first end of the fin pack and a first return header disposed proximate the first end of the fin pack;

a first plurality of U-shaped tubes having a first segment extending from the first supply header at the first end of the fin pack to the second end of the fin pack, and a second segment extending from the second end of the fin pack to the first return header at the first end of the fin pack;

a second supply header disposed proximate the first end of the fin pack and a second return header disposed proximate the first end of the fin pack;

a second plurality of U-shaped tubes having a first segment extending from the second supply header at the first end of the fin pack to the second end of the fin pack, and a second segment extending from the second end of the fin pack to the second return header at the first end of the fin pack;

and the second plurality of U-shaped tubes is disposed inwardly of the first plurality of U-shaped tubes.

12. The refrigeration system of claim 11 wherein the heat exchanger further comprises:

a third supply header disposed proximate the first end of the fin pack and a third return header disposed proximate the first end of the fin pack; and a third plurality of U-shaped tubes having a first segment extending from the third supply header at the first end of the fin pack to the second end of the fin pack, and a second segment extending from the second end of the fin pack to the third return header at the first end of the fin pack;

wherein the third plurality of U-shaped tubes is disposed inwardly of the second plurality of U-shaped tubes.

13. The heat exchanger of claim 12 wherein the first and second segments of the first, second and third plurality of U-shaped tubes are all substantially parallel to one another, and substantially perpendicular to the plurality of fins.

14. The heat exchanger of claim 13 wherein each of the first, second and third plurality of U-shaped tubes includes a third segment connecting the first and second segments.

15. The heat exchanger of claim 14 wherein each of the first, second and third plurality of U-shaped tubes is configured to direct a coolant through the fin pack only twice to minimize pressure drop through the fin pack.

* * * * *